US006719860B1

(12) United States Patent
Leionen

(10) Patent No.: US 6,719,860 B1
(45) Date of Patent: Apr. 13, 2004

(54) METHOD OF PRODUCING ULTRA-FINE GRAIN STRUCTURE FOR UNALLOYED OR LOW-ALLOYED STEEL

(75) Inventor: Jouko Leionen, Tikkasenkaari (FI)

(73) Assignee: Aspector Oy (FI)

( * ) Notice: Subject to any disclaimer, the term of this patent is extended or adjusted under 35 U.S.C. 154(b) by 0 days.

(21) Appl. No.: 10/110,983

(22) PCT Filed: Oct. 18, 2000

(86) PCT No.: PCT/FI00/00902

§ 371 (c)(1),
(2), (4) Date: Apr. 19, 2002

(87) PCT Pub. No.: WO01/29272

PCT Pub. Date: Apr. 26, 2001

(30) Foreign Application Priority Data

Oct. 19, 1999 (FI) ..... 19992263

(51) Int. Cl.[7] ..... C21D 8/00
(52) U.S. Cl. ..... 148/653; 148/654
(58) Field of Search ..... 148/654, 653

(56) References Cited

U.S. PATENT DOCUMENTS 4,466,842 A 8/1984 Yada et al.
4,521,258 A * 6/1985 Tamehiro et al. ..... 148/505
4,619,714 A 10/1986 Thomas et al.

FOREIGN PATENT DOCUMENTS

| | | |
|---|---|---|
| EP | 0903412 A2 | 3/1999 |
| FI | 861437 | 8/2000 |
| JP | 56072127 | 6/1981 |
| JP | 59107023 | 6/1984 |
| JP | 4254520 | 9/1992 |
| WO | WO 98/48061 A1 | 10/1998 |

* cited by examiner

*Primary Examiner*—Deborah Yee
(74) *Attorney, Agent, or Firm*—Connolly Bove Lodge & Hutz LLP

(57) ABSTRACT

A method of producing ultra-fine grain structure for an unalloyed or low-alloyed steel is characterized in that it includes as a combination steps wherein the steel is heated (1, 2) to a temperature (T1) above Ac3 temperature for transforming the structure thereof completely austenitic whereby both temperature level (T1) and holding time (d1) at the temperature (T1) are restricted for hindering austenitic grain growth, the steel is cooled (3) without any deformation below Tnr temperature, rolling (4*a*, 4*b*) is started below Tnr temperature and is continued within the temperature range between Tnr and Ac3 in which the structure of the steel is essentially austenitic but with no recrystallization of austenite, and the steel is cooled further (5) below Ar3 and Ar1 temperatures. The method of the invention is suitable to be used at the final storage of production, especially, for improving some properties, like hardness, tensile strength and impact toughness, of a steel.

7 Claims, 2 Drawing Sheets

METHOD OF PRODUCING ULTRA-FINE GRAIN STRUCTURE FOR UNALLOYED OR LOW-ALLOYED STEEL

The invention is related to a method of producing ultra-fine grain structure for unalloyed or low-alloyed steels. The steels are usually of the hypoeutectoid type, but may be also of the eutectoid type.

Unalloyed and low-alloyed steels are the most significant group of the metals used by the industrialized world. Their properties vary according to carbon content, alloying element contents and the treatments included in the steel manufacturing. Strength, toughness and weldability are the most important properties of low-carbon steels (C<0.25%), and therefore they are widely used in various structures. The widespread use of medium-carbon steels (C=0.25–0.60%), e.g. quench and tempering steels, is based on their high strength and good toughness. Their weldability is poor, however, due to the tendency to hardening caused by rather high carbon content. High-carbon steels (>0.60%) are harder and more resistant to abrasion, but their toughness and also weldability are poorer than in steels with lower carbon content.

Figure 1:
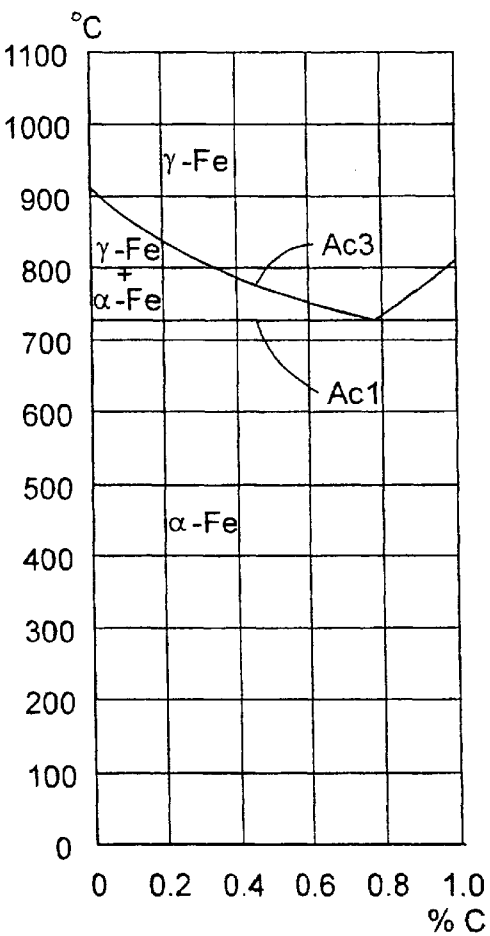

The iron-carbon phase diagram for carbon contents of 0 to 1.0% is presented in FIG. 1. During slow heating below the temperature Ac1, the structure of a steel is naturally ferritic (a-Fe) and/or pearlitic (a-Fe+Fe3C). Between the temperatures Ac1 and Ac3 the more austenite (g-Fe) in addition to ferrite is formed in the structure the higher the temperature is rising, and above the Ac3 temperature the structure is fully austenitic. With slow heating, the Ac1 temperature is about 730° C., and the Ac3 temperature is varying according to carbon content. The Ac3 temperature of pure iron is about 910° C., of steel containing 0.1% carbon about 880° C., and of steel containing 0.75% carbon about 730° C.

During conventional or fast cooling, the transformation of austenite to ferrite and pearlite is not beginning until at the temperature Ar3, which is tens or up to two hundred degrees lower than the Ac3 temperature. Correspondingly, the stopping temperature of the phase transformation, Ar1, is clearly lower than the Ac1 temperature.

In a steel containing more than 0.1% carbon, especially if it contains enough alloying elements increasing hardenability, e.g. manganese, chromium, nickel, or molybdenum, the transformation of austenite into ferrite and pearlite becomes slower and can also be hindered partially or completely by fast cooling. In the structure cooling down, also bainite and/or martensite are then formed at lower temperatures, these phases being stronger than ferritic-pearlitic structure but usually not as tough. In a very fast cooling, i.e. hardening, a fully martensitic structure is aimed at with medium-carbon or high-carbon steels.

Unalloyed and low-alloyed steels are often produced so that molten steel is casted, and then the slabs of an appropriate size are usually heated to 1200 to 1300° C. and rolled thinner, the steel at the same time cooling down. Lastly, a plate, bar, etc. is allowed to cool down or is cooled with accelerated cooling to the room temperature. After hot rolling, some steels are further normalized or austenized for hardening above the Ac3 temperature. For example, a steel to be normalized is usually cooled down to 500° C., only, from where it is heated in a furnace to a temperature of about 30 to 50° C. above the Ac3 temperature (often within the range of 800 to 920° C.) and then usually let to cool down.

Austenizing of medium-carbon and high-carbon steels before hardening is also accomplished above the Ac3 temperature, but with accelerated water or oil cooling the structure is hardened, i.e. changed mainly to martensite. A steel may sometimes be used in this condition for purposes in which good resistance to abrasion is required, although the toughness of the structure remains poor. If also good toughness is desired for a martensitic steel, it has to be tempered at a temperature of about 550 to 650° C. Then a quenched and tempered (QT) steel is concerned which is very suitable for transmission axles, for example, for which both strength and toughness are required.

The strength and toughness properties of a steel can be improved by reducing the grain size of the microstructure. The grain size of the final ferritic-pearlitic structure is the smaller the smaller the grain size of the austenite is and/or the more deformed state the austenite has before cooling and phase transformation. Also the properties of bainitic, martensitic and QT structures will be improved in the same way as the grain size is reduced.

A small grain size is tried to get, for example, by adding small amounts, usually less than 0.1%, of microalloying elements, like niobium, titanium or vanadium, into a molten steel. Very small carbide, nitride and carbonitride precipitates of these alloying elements are then formed in the structure during the phases of steel production. Movement of grain boundaries is hindered by these small precipitates, and thus the grain growth at high temperatures is retarded. Steels alloyed with the above mentioned microalloying elements are often called fine-grained steels.

The grain size of a steel can be reduced also by an improved hot rolling, so-called thermomechanical rolling (TMCP). These so called TM steels are used for very demanding applications, e.g. bridge constructions, because, as low-carbon steels are concerned, the best combination of strength, toughness and weldability is achieved by these steels. TM steels are often also microalloyed steels.

Thermomechanical rolling is carried out at lower temperatures than normal rolling, i.e. below 1200° C., and the rolling is finished near the Ar3 temperature, either a little above it the structure being still austenite or a little below it the structure already containing some ferrite, too. The grain size of austenite is about 20 $\mu$m or larger before the last passes, and after rolling the worked grains are usually prolonged because no recrystallization of the microstructure occur due to the low rolling temperature.

Accelerated cooling to about 500° C. after rolling and lastly slower cooling to the room temperature are often associated with thermomechanical rolling. In low-carbon and high-carbon steels, prolonged grains transform during cooling into ferrite and pearlite. As the ferrite grain size of conventionally rolled steels is 10 to 30 $\mu$m, the grain size of TM steels is usually between 5 to 10 $\mu$m and at its best 4 $\mu$m.

Still smaller grain sizes of microstructure have been achieved by using various methods, whereupon steels with ultra-fine grain size may be spoken about. Mostly UFF (ultra-fine ferrite) steels have been dealt with. For different microstructures, it is difficult to determine the upper limit of ultra-fine grain size, but for ferritic steels it is in every case less than 5 $\mu$m and preferably from 1 to 3 $\mu$m. Pearlite and also bainite and martensite are formed in different ways than ferrite, and their grain sizes are typically a little larger, which is true also for steels with ultra-fine grain size.

A method combined with hot rolling of carbon or carbon-manganese steels with low carbon content is presented in U.S. Pat. No. 4,466,842 (Yada et al.), in which method heavy working is carried out during the final stages of hot rolling near the Ar3 temperature. The ferrite grain size obtained is about 4 $\mu$m after a reduction of 40%, about 3 $\mu$m after a reduction of 60%, and about 2 $\mu$m after a reduction of 75% or more.

In some cases, heat treatment of steel may result in a grain size as small as 3 μm. A method has been presented in the applicant's international patent application PCT/FI98/00334, by which method, depending on the steel type and possibilities to carry out the heat treatment, a grain size of about 5 μm, and even a grain size of up to 3 μm with some steels and process parameters, can be achieved. The method usually necessitates fast or very fast temperature changes e.g. during heating and cooling, and therefore the realization thereof in practical production processes is often problematic.

An object of the present invention is to present a method which is simple and easy to realize and may be applied as widely as possible for producing an ultra-fine grain size for a steel.

A method according to the invention is characterized in that what is defined in claim 1 of the appended claims. In the other claims, various embodiments of the invention are defined.

The method according to the invention can be used instead of conventional thermomechanical treatments and fine-grain treatments or together with them for improving properties, especially the strength and toughness, of unalloyed or low-alloyed hypoeutectoid or eutectoid steels (carbon content not more than 0.8%). The necessary treatment can be carried out easily and with simple operations during the last stage of a conventional manufacturing process. Any special working methods or very strong working are not needed. After the treatment, the microstructure of a steel can include ferrite, pearlite, bainite and/or martensite.

Figure 2B:
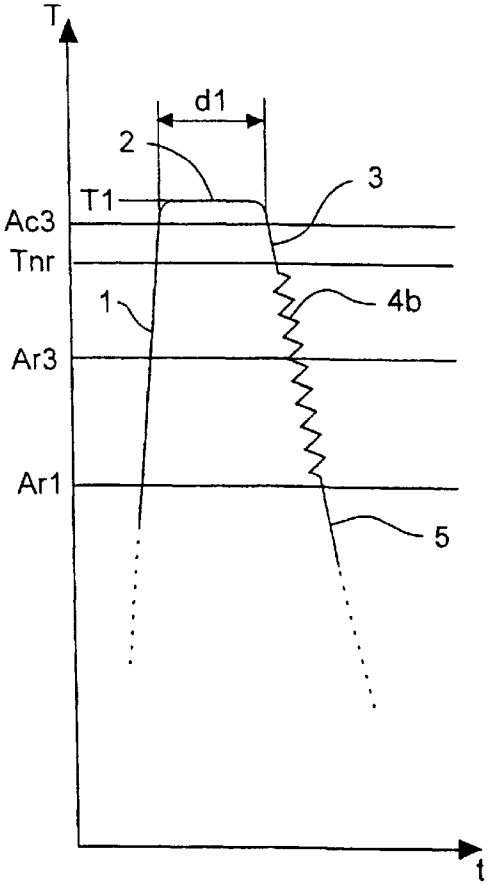
Figure 2A:
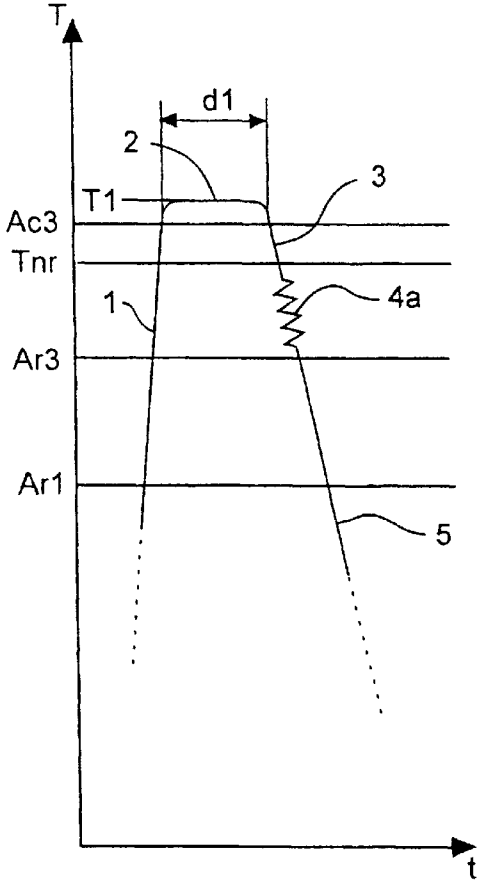
Figure 3:
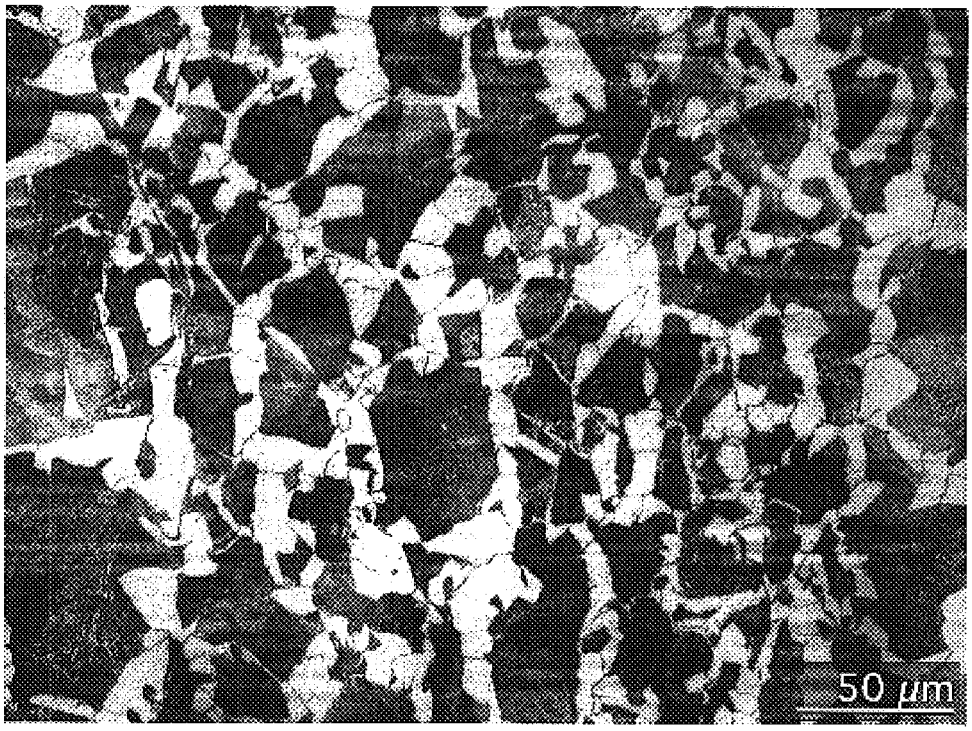
Figure 4:
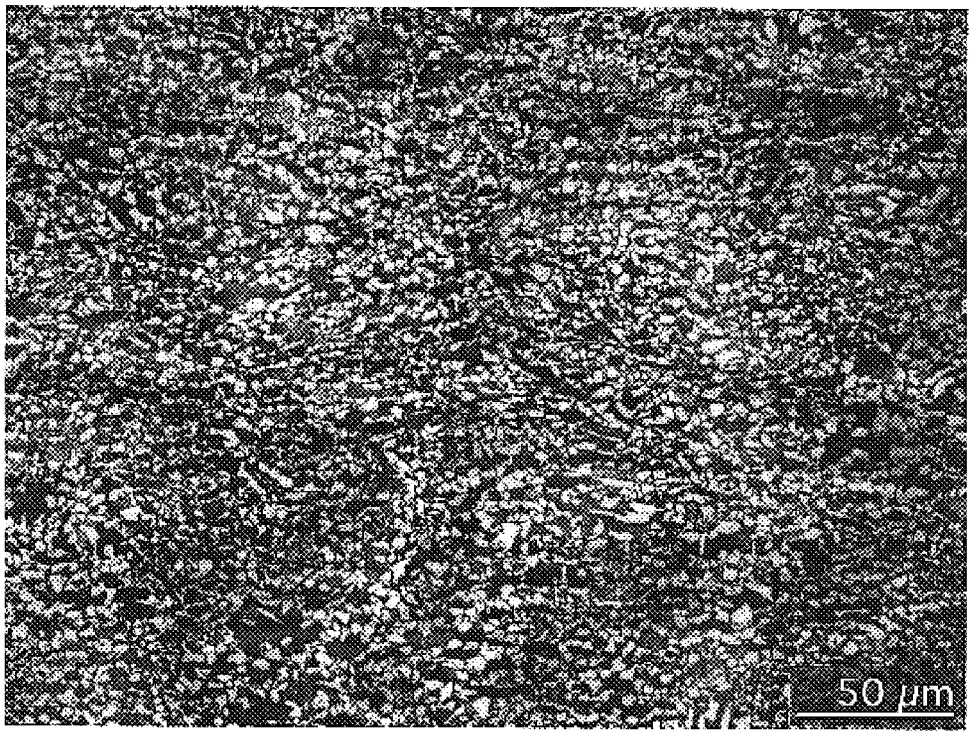

The invention and some embodiments examples thereof are described in further detail in the following with the reference to the appended drawings, in which:

FIG. 1 presents, as an information helping to understand the description of the invention, the Fe—C equilibrium diagram for carbon contents of 0 to 1.0% during slow heating;

FIGS. 2(*a*) and 2(*b*) are diagrams presenting schematically some embodiments of the method according to the invention; and FIGS. 3 and 4 present microstructures of a steel after conventional hot rolling and after using the method according to the invention, respectively.

Phase transformations of steel and relating temperatures Ac1 and Ac3 have been explained in the introduction above with reference to FIG. 1.

As already mentioned in the introduction, transformation of austenite to ferrite and pearlite is during conventional or fast cooling not beginning until at the temperature Ar3, which is tens or up to two hundred degrees lower than the Ac3 temperature. Correspondingly, the finishing temperature of phase transformation, Ar1, is clearly lower than the Ac1 temperature. In addition to these temperatures, the diagrams of FIGS. 2(*a*) and 2(*b*) include the temperature Tnr (nr=non-recrystallization) below which the deformed austenite grains are not recrystallized further. The Tnr temperature of unalloyed steels is often about 800° C. Exemplary values of Ar3 and Ar1 are here about 680° C. and about 500° C., respectively. The Tnr temperatures of micro-alloyed steels can be much higher, up to 1050° C.

In a treatment according to the invention, the embodiments of which are illustrated by the diagrams of FIGS. 2(*a*) and 2(*b*), a steel is first heated during stage 1 to a temperature T1 above Ac3 for transforming the microstructure (ferrite, pearlite, etc.) essentially fully into austenite. The temperature T1 is held low enough so that too strong grain growth of austenite is hindered. An adequate temperature for low-carbon and medium-carbon steels is often about 900° C., and even for low-alloyed steels it is not higher than 1150° C. Also the holding time d1 above the Ac3 temperature (stage 2) is controlled and constricted for constraining grain growth of austenite. During this stage, the grain size of austenite is tried to be kept as 15 μm or smaller, and often it is possible to keep it in the range of about 10 μm.

After a constricted holding time, the steel is in stage 3 cooled down below the temperature Tnr. No working is carried out during the annealing 2 above the Ac3 temperature and during the cooling stage 3, rolling being not started until below the temperature Tnr wherein austenite grains are prolonged during rolling and remain flat because no more recrystallization of austenite occurs. In the embodiment of FIG. 2(*a*), rolling 4*a* is finished above the Ar3 temperature or in the region where austenite begins to transform to e.g. ferrite. In the embodiment of FIG. 2(*b*), rolling 4*b* will continue down to the temperature Ar1 where the austenite structure has been completely decomposed, i.e. transformed to e.g. ferrite and pearlite. The rolling is carried out as one or more passes. After the rolling, the steel is cooled or allowed to cool in stage 5. The final microstructure of a steel can be affected by the cooling rate as well as naturally by rolling characteristics, for example by its heaviness.

In practice, the rolling could be carried out between the temperatures Tnr and Ar1, which can be from 800 to 500° C., for example. When the rolling is continuing also below the temperature Ar3, the earlier deformed austenite grains as well as the newly transformed new ferrite grains (and the pearlite colonies developed at lower temperatures) will be deformed. When the temperature is near the temperature Ar1, only a small part of all grains are austenite grains. They have been transformed to ferrite and pearlite.

These temperature boundaries are fully specific for a steel. An exact quantification of the temperatures Tnr, Ar3 and Ar1 is laborious in practice. Mathematical equations are often utilized for that.

The treatment according to the novel method can be connected with normalizing annealing, for example. Then, the austenite grain size is often less than 10 μm. As this kind of fine-grained microstructure is rolled below the Tnr temperature but, however, beyond the Ar3 temperature, i.e. in the austenite region, the small austenite grains are prolonged and remain unchanged during cooling down to the phase transformation. For example, the Tnr and Ar3 temperatures of a medium-carbon steel containing 0.33% carbon are 840° C. and 630° C., respectively. According to the tests carried out, the ferrite grain size of low-carbon and medium-carbon steels after phase transformations is about 2 to 3 μm, or only one half compared with the grain size of a steel plate rolled thermomechanically in a conventional way. The strength and impact toughness of these ultra-fine grain steels are essentially better than those of steels rolled thermomechanically in a conventional way.

A micrograph taken from the microstructure of the above-mentioned medium-carbon steel after conventional hot rolling is presented in FIG. 3, and a micrograph taken from the microstructure after the treatment according to the invention is presented in FIG. 4.

In the following, some examples of experimental results are presented which have been obtained by applying the method of the invention to steels of different types:

Example 1

Hot Rolled Carbon-manganese Steel (SFS-EN 10025-S355J0)

The carbon content of this steel is 0.15%, and the manganese content is 1.2%. The dimensions of the test specimens before rolling are: thickness 8 mm, width 30 mm, and length 140 mm. The test specimens were held in an air furnace at 880° C. for 40 minutes in the way corresponding to heating and annealing during normalizing. After this time period, the test specimens were slowly cooled to the rolling temperature, in one case to 800° C. and in two other cases to 750° C. Rolling with one pass was carried out by using a laboratory roller, and the reduction ratio was 45%. After rolling, two test specimens were cooled to the room temperature using accelerated air cooling (from 750° C. and 800° C., cooling rate about 15° C./s). One specimen was cooled slowly after rolling (from 750° C., cooling rate about 4° C./s).

The microstructure of the steel before the treatment according to the novel method was ferritic-pearlitic, and the ferrite grain size was about 15 μm (ASTM No. 9). After the treatment, as accelerated air cooling was used, the ferrite grain size was 2.5 to 3.0 μm (ASTM No. 14). The minimum grain size (2.5 μm) was obtained as the rolling temperature was 750° C. and the maximum grain size (3.0 μm) as the rolling temperature was 800° C. When the other test specimen rolled at 750° C. was cooled slowly after rolling to the room temperature (cooling rate about 4° C./s), the ferrite grain size was 3.5 μm (ASTM No. 13).

Example 2

High Strength Microalloyed Steel (SFS-EN 10149-2-S650MC)

The carbon content of this steel is 0.08%, the silicon content 0.20%, and the manganese content 1.7%. In addition, the steel contains small amounts of microalloying elements for reducing grain size.

For this steel, similar tests were carried out as for the steel of Example 1. The ferrite grain size after the treatment according to the novel method was 2.4 to 2.8 μm as accelerated air cooling was used and 3.6 μm with slow cooling.

Example 3

Medium-carbon Steel in Hot Rolled Condition

The carbon content of this medium-carbon steel is 0.33%, the silicon content 0.3%, and the manganese content 1.2%. This kind of steel is normally in hot-rolled, normalized, quenched or quenched and tempered condition. The steel does not contain any other alloying elements than silicon and manganese.

The steel used in the tests was initially in hot-rolled condition (FIG. 3).

The test specimens were held in an air furnace at 880° C. for 40 min, after which they were cooled and rolled, one specimen at 800° C. and the other at 720° C. The reduction was 45%. Accelerated air cooling was used after rolling, with a cooling rate of about 8° C./s. The microstructure contained pearlite and ferrite, and the ferrite grain size was about 2 μm (ASTM No. 15) as the rolling temperature was 720° C. (FIG. 4). As may be seen in FIG. 4, white ferrite grains are smaller than gray or black pearlite colonies.

In addition to the mentioned laboratory rolling experiments, numerous other experiments simulating rolling have been carried out by using a thermomechanical simulator. Also on the basis of these experiments, it has been possible to verify the surprising finding that ultra-fine grain size can be achieved also by using rather small reduction ratios. It can be concluded, based on the experiments, that the total reduction ratio has to be at least 15% for achieving ultra-fine grain size (1 to 3 μm) in a steel. It has also been found that the cooling rate after rolling has to be at least 5° C./s for ensuring ultra-fine grain size.

An essential feature of the novel method is that the austenite grain growth is constrained as much as possible before rolling. Preferably, the grain size is then not more than about 15 μm. The austenite grain size during normalization annealing can be even less than 10 μm. Still smaller austenite grain sizes can be achieved by using fast heating and a short annealing time, resulting in an austenite grain size of even less than 6 μm before rolling.

The invention can be widely applied in the industry producing e.g. plates, bars and wires from unalloyed or low-alloyed hypoeutectoid or eutectoid steels. The method according to the invention is very appropriate to be used in the last stage of production for improving properties of steel, e.g. hardness, tensile strength and impact toughness.

The invention and some embodiments thereof are described above, and examples based on experimental results about its implementation and effects in manufacturing of some kind of steels have been presented. In view of the description and the examples, it is apparent that the accomplishment of the invention may vary widely depending, for example, on carbon content of a steel. Similarly, the cooling rate of a steel affects the phase structure, which may contain ferrite, pearlite, bainite and/or martensite.

The invention may be varied within the scope defined in the appended claims.

What is claimed is:

1. A method of producing ultra-fine grain structure for an unalloyed or low-alloyed hypoeutectoid or eutectoid steel, comprising:

heating the steel to a temperature above the Ac3 temperature for transforming the structure of the steel into fully austenitic structure, while constraining the temperature T1 and the holding time at the temperature T1 for hindering the grain growth of the austenite so that the mean grain size is not more than 15 μm prior to rolling of the steel;

cooling the steel below the Tnr temperature without working the steel, starting rolling of the steel below the Tnr temperature and continuing rolling of the steel in a region below the Tnr temperature and no more than the Ar3 temperature where the structure of the steel is essentially austenitic but no recrystallization of the austenite occurs; and cooling the steel further below the Ar3 and Ar1 temperatures, wherein the mean grain size of a resulting microstructure of the steel is not more than 3 μm after cooling of the steel further below the Ar3 and Ar1 temperatures.

2. A method according to claim 1, wherein the rolling of the steel is continued in the region between the temperatures Ar3 and Ar1.

3. A method according to claim 1, wherein the temperature T1 above the Ac3 temperature is not over 1150° C.

4. A method according to claim 1, wherein the temperature of the steel is raised above the Ac3 temperature in the last stage of the manufacturing process of the steel.

5. A method according to claim 1, wherein the resulting microstructure of the steel contains one or more of the following phases: ferrite, pearlite, bainite, and martensite, the microstructure being dependent on composition of the steel and on the rate by which the steel is cooled from the rolling temperature to the room temperature.

6. A method according to claim 1, wherein the cooling rate of the steel after the rolling is at least 5° C./s.

7. A method according to claim 1, wherein the carbon content of the steel is not more than 0.8%.

* * * * *